US010049813B2

(12) United States Patent
Ruehl

(10) Patent No.: US 10,049,813 B2
(45) Date of Patent: Aug. 14, 2018

(54) METHOD OF ROLL-FORMING WITH GAP FILLERS FOR SOLENOID USED FOR TRANSMISSION

(71) Applicant: BORGWARNER, INC., Auburn Hills, MI (US)

(72) Inventor: Philip A. Ruehl, Auburn Hills, MI (US)

(73) Assignee: BORGWARNER INC., Auburn Hills, MI (US)

( * ) Notice: Subject to any disclaimer, the term of this patent is extended or adjusted under 35 U.S.C. 154(b) by 200 days.

(21) Appl. No.: 15/137,069

(22) Filed: Apr. 25, 2016

(65) Prior Publication Data

US 2017/0309399 A1 Oct. 26, 2017

(51) Int. Cl.

| | |
|---|---|
| ***H01F 7/06*** | (2006.01) |
| ***H01F 41/04*** | (2006.01) |
| ***B21B 1/08*** | (2006.01) |
| ***B21B 23/00*** | (2006.01) |

(52) U.S. Cl.

CPC ..... *H01F 41/04* (2013.01); *B21B 1/08* (2013.01); *B21B 23/00* (2013.01); *Y10T 29/4902* (2015.01)

(58) Field of Classification Search

CPC ..... Y10T 29/4902; Y10T 156/1085; Y10T 83/9464; B21B 1/08; B21B 23/00

USPC ..... 29/602.1, 428, 455.1, 525, 525.06, 598, 29/732, 890.053

See application file for complete search history.

(56) References Cited

U.S. PATENT DOCUMENTS

| | | | | |
|---|---|---|---|---|
| 4,706,488 | A | 11/1987 | Williamson | |
| 5,881,448 | A * | 3/1999 | Molnar | H02K 1/278 29/598 |
| 7,871,060 | B2 | 1/2011 | Armour | |
| 8,261,592 | B2 | 9/2012 | Mehta et al. | |
| 8,356,506 | B2 * | 1/2013 | Szuba | B21D 17/04 72/367.1 |
| 8,528,599 | B2 | 9/2013 | Morgan et al. | |
| 2011/0302982 | A1 | 12/2011 | Weaver, Jr. | |
| 2012/0299673 | A1 | 11/2012 | Mehta | |
| 2014/0111295 | A1 | 4/2014 | Mehta | |
| 2015/0028168 | A1 | 1/2015 | Morris | |
| 2015/0170801 | A1 | 6/2015 | Talbot et al. | |

* cited by examiner

*Primary Examiner* — Thiem Phan
(74) *Attorney, Agent, or Firm* — Howard & Howard Attorneys PLLC

(57) ABSTRACT

A method of roll-forming with gap fillers for a solenoid used for a transmission includes the steps of providing a can of a solenoid, the can having a discontinuous surface with a gap, providing additional material in the gap, and roll-forming the additional material in the gap simultaneously with roll-forming the can to maintain a smooth path for rollers during roll-forming for the solenoid.

13 Claims, 7 Drawing Sheets

METHOD OF ROLL-FORMING WITH GAP FILLERS FOR SOLENOID USED FOR TRANSMISSION

BACKGROUND OF INVENTION

1. Field of Invention

The present invention relates generally to roll-forming and, more specifically, to a method of roll-forming with gap fillers for a solenoid used for a transmission.

2. Description of the Related Art

Conventional vehicles known in the art typically include an engine having a rotational output that provides a rotational input into a transmission such as an automatic transmission for a powertrain system of the vehicle. The transmission changes the rotational speed and torque generated by an output of the engine through a series of predetermined gearsets to transmit power to one or more wheels of the vehicle, whereby changing between the gearsets enables the vehicle to travel at different vehicle speeds for a given engine speed.

In addition to changing between the gearsets, the automatic transmission is also used to modulate engagement with the engine, whereby the transmission can selectively control engagement with the engine so as to facilitate vehicle operation. By way of example, torque translation between the engine and the automatic transmission is typically interrupted while the vehicle is parked or idling, or when the transmission changes between the gearsets. In conventional automatic transmissions, modulation is achieved via a hydrodynamic device such as a hydraulic torque converter. However, modern automatic transmissions may replace the torque converter with one or more electronically and/or hydraulically actuated clutches (sometimes referred to in the art as a "dual clutch" automatic transmission). Automatic transmissions are typically controlled using hydraulic fluid, and include a pump assembly, one or more hydraulic solenoid valves, and an electronic controller. The pump assembly provides a source of fluid power to the solenoid valves which, in turn, are actuated by the controller so as to selectively direct hydraulic fluid throughout the automatic transmission to control modulation of rotational torque generated by the output of the engine. The solenoid valves are also typically used to change between the gearsets of the automatic transmission, and may also be used to control hydraulic fluid used to cool and/or lubricate various components of the transmission in operation.

One type of solenoid for the solenoid valves includes a coil, a sleeve, a connector, and a can. An example of such as solenoid is disclosed in U.S. Pat. No. 8,528,599 to Morgan et al. In this solenoid, a solenoid portion includes a solenoid housing or can enveloping a bobbin coil assembly (including a bobbin member and a coil member). The bobbin coil assembly envelopes an armature assembly (including a selectively movable armature member and a stem or pin member extending therefrom). A sleeve member envelopes the armature member. The sleeve member and the armature member define a dampening portion within the interior of the sleeve member. A pole piece member is preferably provided in proximity to a valve portion and is spaced and opposed from the dampening portion. A terminal member extends from the bobbin member, and is preferably in communication with one or more electrical conduction members (e.g., wires) associated with the insulator member.

It is known to use roll-forming by manufactures for various products. Roll-forming is a process where manufacturers apply loads slowly using rollers to bend components, thereby imparting less load on the components being formed and reducing the risk of damage to the components. An example of roll-forming is disclosed in U.S. Pat. No. 4,706,488 to Williamson, the entire disclosure of which is hereby incorporated by reference. When using roll-forming, a continuous surface is strongly preferred because gaps will introduce impact loads/tool chatter that can shorten tool life or cause damage to the finished component.

Therefore, it is desirable to integrate one or more components in a solenoid to help fill in the gaps so that the rollers see a more continuous surface. It is also desirable to provide material in a gap to act as a gap filler that is capable of absorbing the roll-forming load and deforming with the roll-formed surface. Thus, there is a need in the art to provide a method of roll-forming with gap fillers for a solenoid used with a transmission.

SUMMARY OF THE INVENTION

The present invention provides a method of roll-forming with gap fillers for a solenoid used with a transmission. The method includes the steps of providing a can of a solenoid, the can having a discontinuous surface with a gap, providing additional material in the gap, and roll-forming the additional material in the gap simultaneously with roll-forming the can to maintain a smooth path for rollers during roll-forming of the solenoid.

One advantage of the present invention is that a new method of roll-forming with gap fillers for a solenoid used with a transmission is provided. Another advantage of the present invention is that the method integrates one or more components to help fill in the gaps in the roll formed surface so that the rollers see a more continuous surface. Yet another advantage of the present invention is that the method uses material to act as a gap filler that is capable of absorbing the roll-forming load and deforming with the roll-formed surface. Still another advantage of the present invention is that the method improves the quality of a non-continuous roll-formed joint.

BRIEF DESCRIPTION OF THE DRAWINGS

Other objects, features, and advantages of the present invention will be readily appreciated as the same becomes better understood after reading the subsequent description taken in connection with the accompanying drawings wherein.

DETAILED DESCRIPTION OF THE INVENTION

Figure 1:
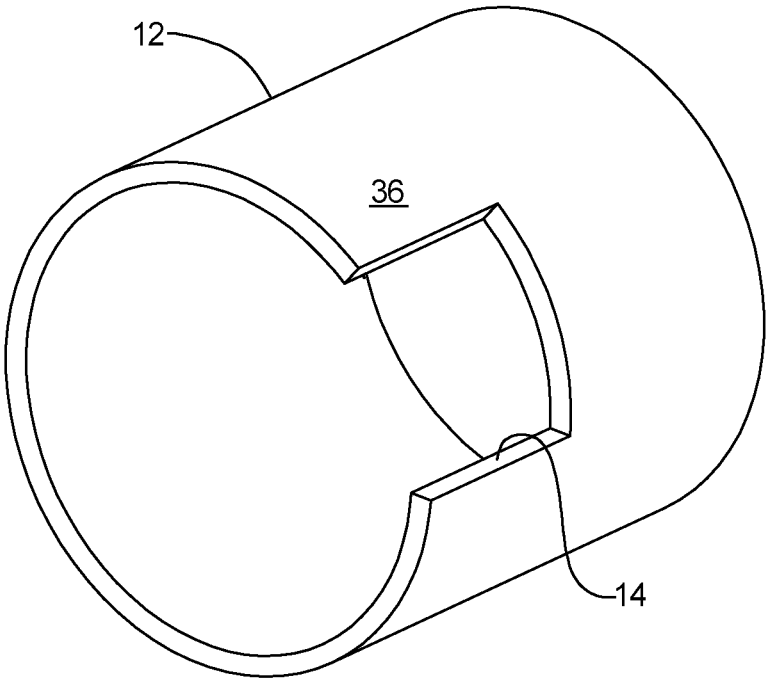
FIG. 1 is a perspective view of a can for a solenoid used in a transmission of a vehicle illustrated with a gap.
Figure 3:
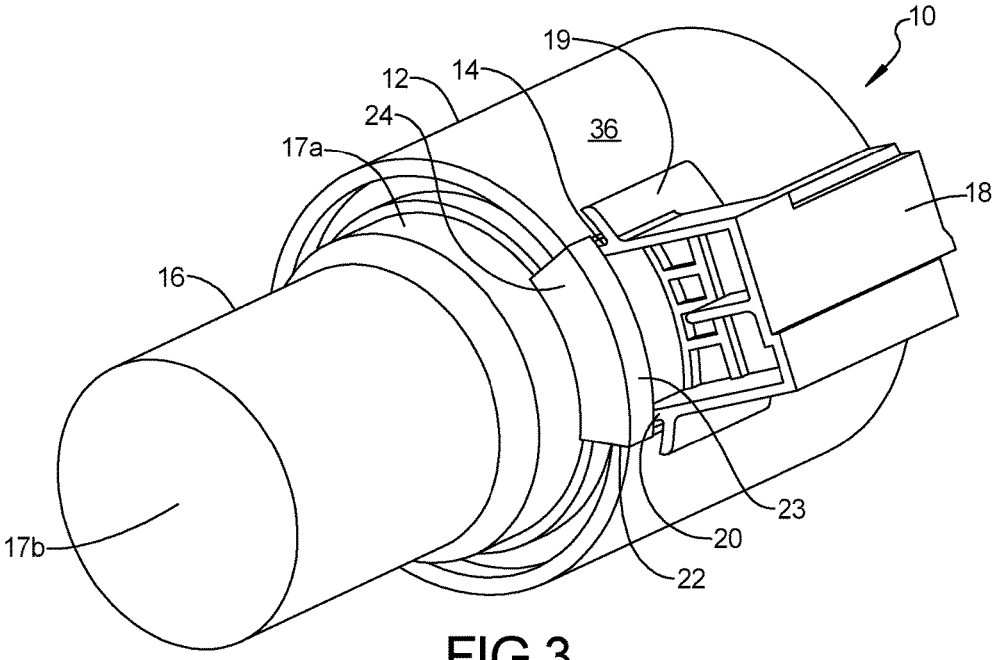
FIG. 3 is a view similar to FIG. 2 illustrating a method, according to one embodiment of the present invention, of roll-forming with gap fillers where a sleeve installed from an axial end of the can with the gap includes a feature adding additional material to the gap.
Figure 4:
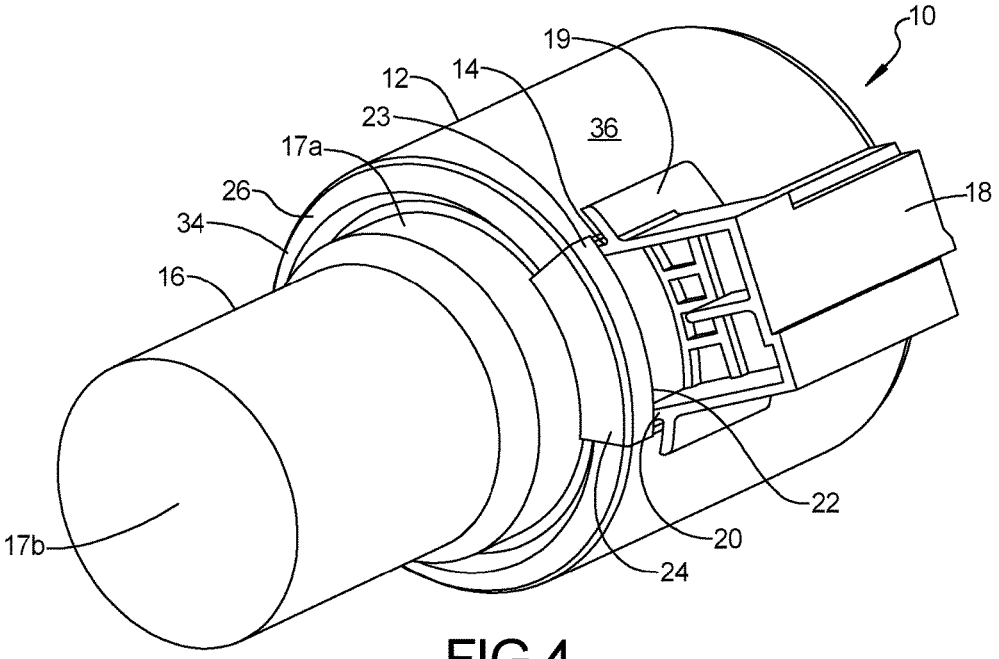
FIG. 4 is a view similar to FIG. 3 illustrating the method, according to one embodiment of the present invention, of roll-forming with gap fillers including roll-forming the additional material in the gap simultaneously with roll-forming the can.

Referring now to the figures, where like numerals are used to designate like structure unless otherwise indicated, a solenoid is generally indicated at 10 in FIGS. 3 and 4 is used for a transmission (not shown). The solenoid 10 includes a can 12 as illustrated in FIG. 1. The can 12 is generally hollow and cylindrical in shape. The can 12 has a generally circular cross-sectional shape. The can 12 includes at least one space or gap 14 therein. In one embodiment, the gap 14 is generally rectangular in shape and extends axially therein from one axial end of the can 12. The can 12 is made of a metal material. It should be appreciated that the can 12 is conventional and known in the art. It should also be appreciated that an example of a can is disclosed in U.S. Pat. No. 8,528,599 to Morgan et al., the entire disclosure of which is hereby expressly incorporated by reference. It should also be appreciated that in order to assemble a coil and electrical connector 18 to the can 12, there must be a gap 14 in the can 12 where it will be formed.

Figure 2:
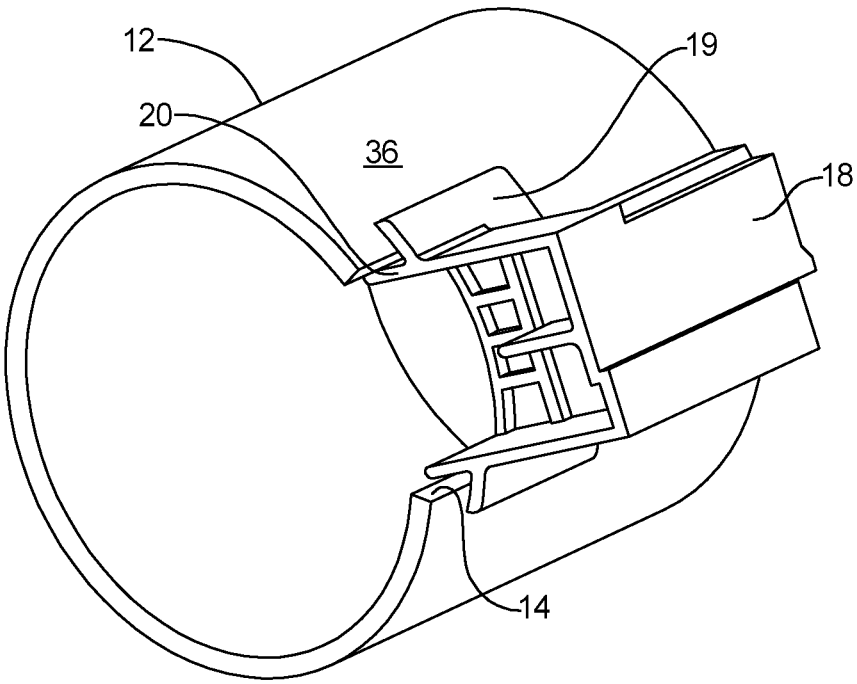
FIG. 2 is a perspective view of the can of FIG. 1 illustrated with a connector installed from an axial end of the can with the gap.

Referring to FIGS. 2-4, the solenoid 10 includes a sleeve 16 (FIGS. 3 and 4) and an electrical connector 18 connected to the sleeve 16. In one embodiment, the sleeve 16 is generally cylindrical in shape and includes a first portion 17*a* and a second portion 17*b* extending axially from the first portion 17*a* and having a diameter less than the first portion 17*a*. The sleeve 16 is generally circular in cross-sectional shape. It should be appreciated that the first portion 17*a* is disposed within the can 12 and the second portion 17*b* extends axially from the first portion 17*a*.

The connector 18 is generally rectangular in shape, but may be any suitable shape. The connector 18 includes a first flange 19 extending circumferentially therefrom and a second flange 20 extending radially therefrom. The first flange 19 extends over a portion of the can 12 and the second flange 20 extends into the gap 14. The connector 18 extends radially and axially from the sleeve 16. The sleeve 16 may be made of a plastic material or a metal material. It should be appreciated that the sleeve 16 and connector 18 may be integral and one-piece. It should also be appreciated that the sleeve 16 and connector 18 are both installed from the axial end of the can 12 with the gap 14. It should further be appreciated that the solenoid 10 may be of a type employed in a conventional transmission of a powertrain system for a vehicle.

Referring to FIG. 3, the solenoid 10 includes additional material 22 disposed in the gap 14 of the can 12. In order to provide a smooth path for rollers (not shown) during roll-forming, the additional material 22 is added to the sleeve 16. The additional material 22 is generally "L" shaped in cross-section. The additional material 22 may be any material, such as a plastic material or metal material, capable of absorbing a roll-forming load and deforming with a roll-formed surface to be described. It should be appreciated that the purpose of the additional material 22 is to integrate one or more separate components to help fill in the gap 14 so that the rollers see a more continuous surface during roll-forming of the can 12. It should also be appreciated that, when using roll-forming, a continuous surface is strongly preferred because gaps will introduce impact loads/tool chatter that can shorten tool life or damage the finished component.

Figure 5:
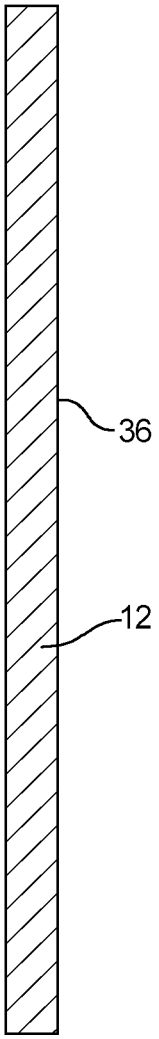
FIG. 5 is a cross-sectional view of the can before using the method, according to one embodiment of the present invention, of roll-forming with gap fillers.
Figure 6:
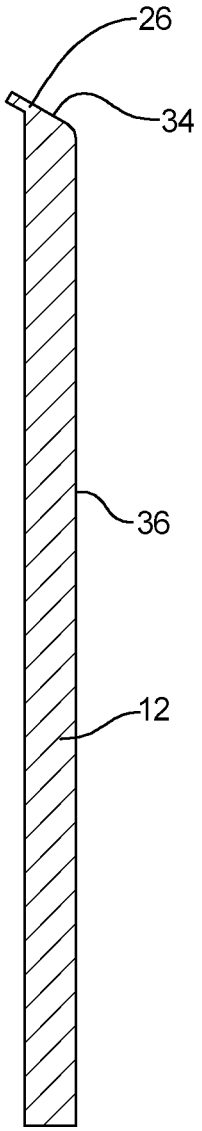
FIG. 6 is a view similar to FIG. 5 illustrating the method, according to one embodiment of the present invention, of roll-forming with gap fillers.

Referring to FIG. 4, the additional material 22 on the sleeve 16 is displaced during roll-forming to maintain a smooth path for the rollers and to secure the sleeve 16 and connector 18 to the can 12. In one embodiment, the additional material 22 includes a first portion 23 extending axially in the gap 14 of the can 12. The additional material 22 also includes a second portion 24 extending radially and circumferentially from the first portion 23 across the gap 14. The second portion 24 of the additional material 22 is continuous with a flange portion 26 of the can 12 formed by the roll-forming method. As illustrated in FIG. 5, the can 12 extends generally axially in cross-section. As illustrated in FIG. 6, one axial end of the can 12 is roll-formed by the rollers to form the flange 26 of the can 12 extending radially and circumferentially. It should be appreciated that the additional material 22 melds or integrates with the material of the sleeve 16 and/or can 12.

The flange 26 has a roll-formed surface 34 formed by the roll-forming method. In one embodiment, the sleeve 16 may be a dummy member made of a plastic material. The additional material 22 is made of a plastic material and is part of the sleeve 16. It should be appreciated that the additional material 22 and sleeve 16 are integral, unitary, and formed as one-piece.

The solenoid 10 includes a pole piece member (not shown) and a bobbin (not shown) disposed about the pole piece member and the can 12 encloses the bobbin. The bobbin has a primary electromagnetic coil (not shown) wound thereon to create a magnetic field when energized. The solenoid 10 also includes the connector 18 for connecting with the electromagnetic coil and to ground (not shown). It should be appreciated that the connector 18 receives a continuous variable, digital control signal from a primary driver (not shown) such as the electronic controller (not shown).

Figure 7:
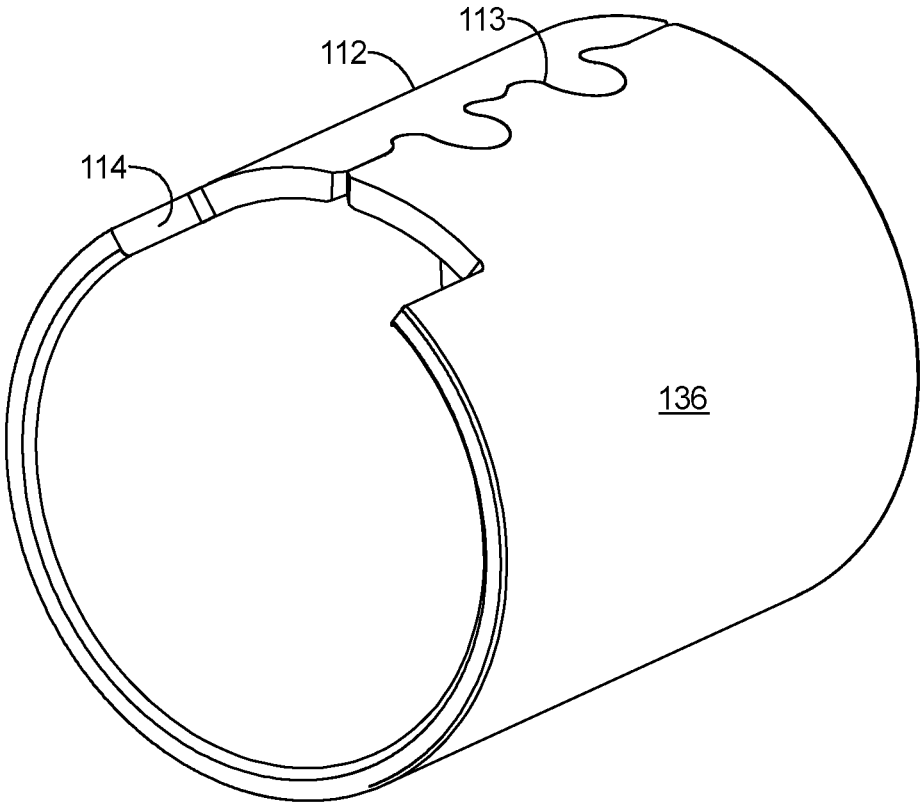
FIG. 7 is a perspective view of another embodiment of a can for a solenoid used in a transmission of a vehicle illustrated with a gap; p
Figure 9:
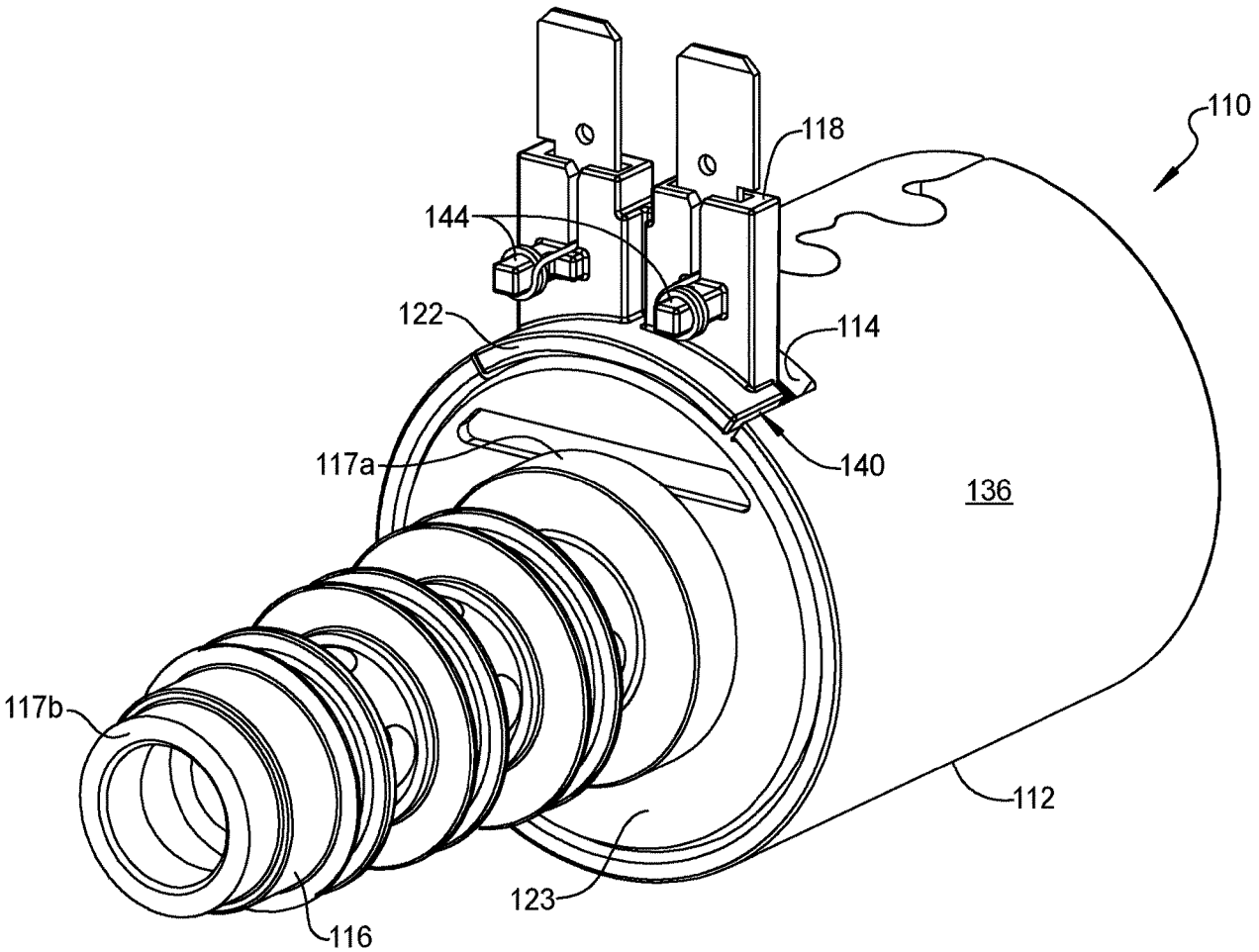
FIG. 9 is a view similar to FIG. 8 illustrating a method, according to one embodiment of the present invention, of roll-forming with gap fillers where a bobbin installed from an axial end of the can with the gap includes a feature adding additional material to the gap.
Figure 10:
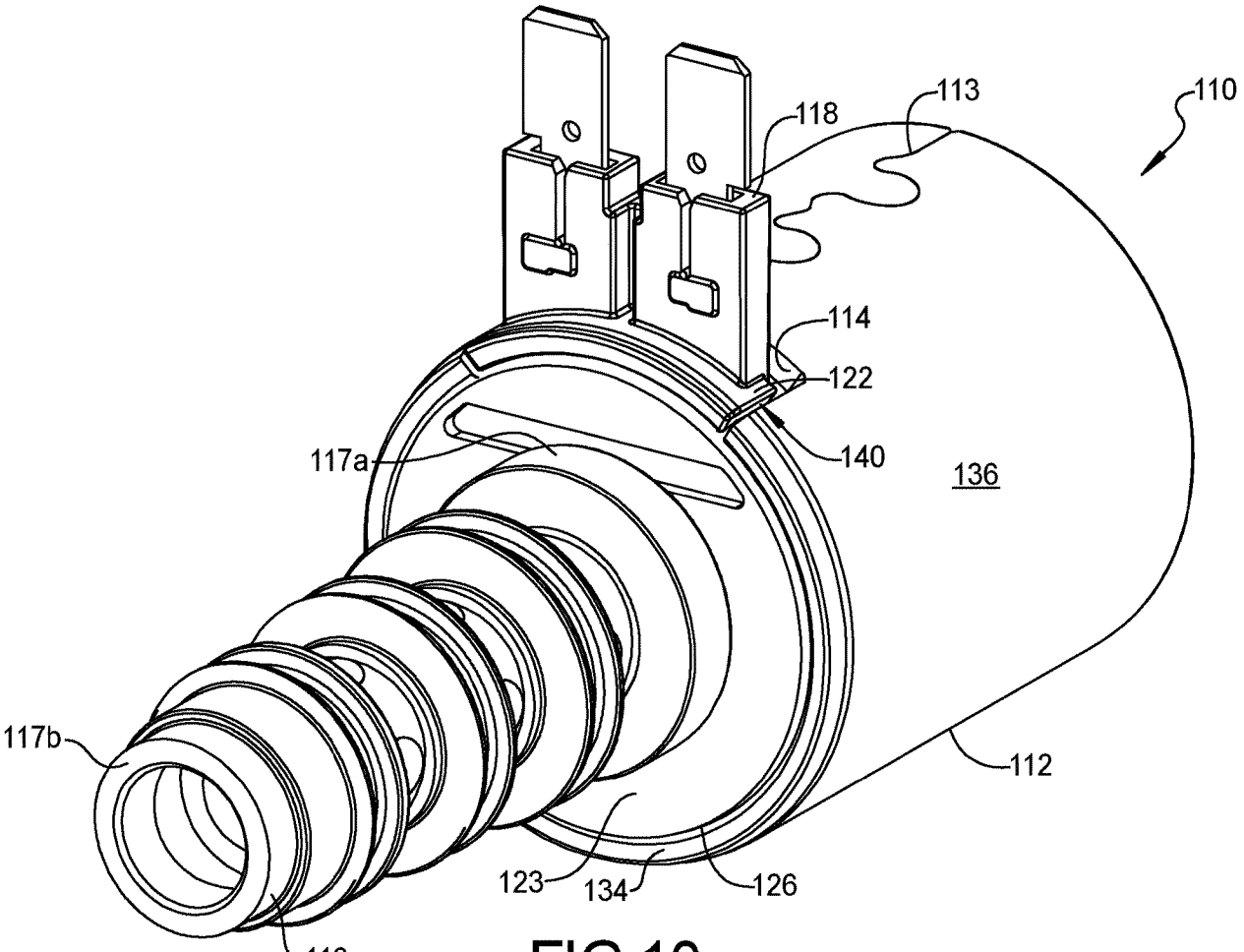
FIG. 10 is a view similar to FIG. 9 illustrating the method, according to one embodiment of the present invention, of roll-forming with gap fillers including roll-forming the additional material in the gap simultaneously with roll-forming the can.

Referring to FIGS. 9 and 10, another embodiment of the solenoid 10 is generally indicated at 110 is used for a transmission (not shown). Like parts of the solenoid 10 have like reference numerals increased by one hundred (100). In this embodiment, the solenoid 110 includes a can 112 as illustrated in FIG. 7. The can 112 is generally hollow and cylindrical in shape. The can 112 has a generally circular cross-sectional shape. The can 112 includes at least one space or gap 114 therein. In one embodiment, the gap 114 is generally rectangular in shape and extends axially therein from one axial end of the can 112. The can 112 is made of a metal material. In one embodiment, the can 112 may be one piece and formed circumferentially such that the lateral ends form a separation line 113. It should also be appreciated that in order to assemble a bobbin assembly, pole piece, and/or sleeve to the can 112, there must be a gap 114 in the can 112 where it will be formed. It should further be appreciated that the subsequent description describes the assembly process of the solenoid 110 with a non-continuous roll-formed joint.

Figure 8:
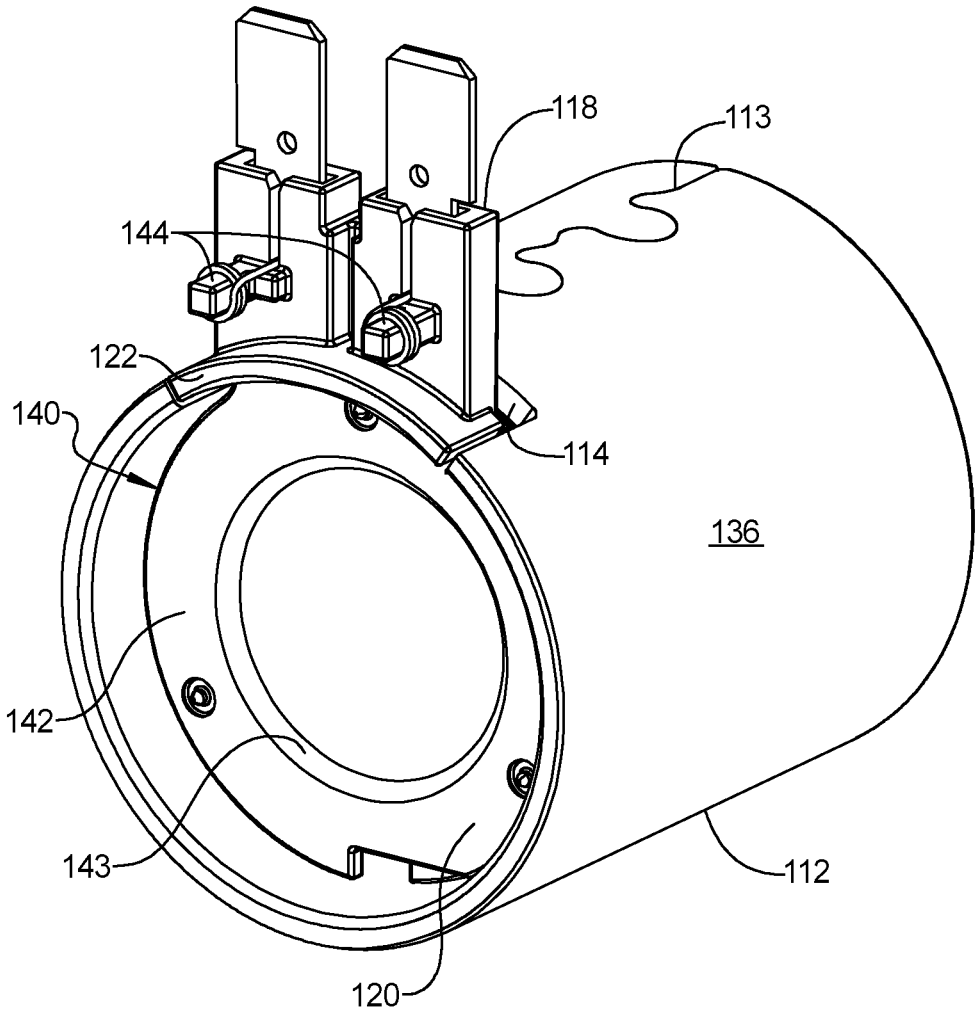
FIG. 8 is a perspective view of the can of FIG. 7 illustrated with another connector installed from an axial end of the can with the gap.

Referring to FIG. 8, the solenoid 110 includes a bobbin assembly, generally indicated at 140, including a bobbin 142 disposed in the can 112 and a connector 118 connected to the bobbin 142. The bobbin 142 is generally circular in shape with an aperture 143 extending axially therethrough. The bobbin 142 extends radially to the connector 118. The bobbin 142 is made of a metal or plastic material. The connector 118 is generally rectangular in shape, but may be any suitable shape. The connector 118 extends radially and axially from the can 112. The connector 118 includes one or more winding towers 144 extending axially therefrom. It should be appreciated that one or more connectors 118 may be provided.

The bobbin assembly 140 includes additional material 122 extending axially and circumferentially from the bobbin 142. The additional material 122 extends into the gap 114. The additional material 122 may be any material, such as a plastic material or metal material, capable of absorbing a roll-forming load and deforming with a roll-formed surface to be described. It should be appreciated that the purpose of the additional material 122 is to integrate one or more separate components to help fill in the gap 114 so that the rollers see a more continuous surface during roll-forming of the can 112. It should be appreciated that the winding towers 144 of the connector 118 would have to be cut off before roll-forming. It should also be appreciated that the bobbin assembly 140 is installed from the axial end of the can 112 with the gap 114. It should further be appreciated that the additional material 122 is molded into the bobbin 142 to make a path for the rollers between the edges of the opening or gap 114 in the can 112. It should also be appreciated that, when using roll-forming, a continuous surface is strongly preferred because gaps will introduce impact loads/tool chatter that can shorten tool life or damage the finished component.

Referring to FIG. 9, the solenoid 110 includes a pole piece 123 disposed within the can 112. The bobbin 142 is disposed about the pole piece 123 and the can 112 encloses the bobbin 142. In order to provide a smooth path for rollers (not shown) during roll-forming, the pole piece 123 supports the additional material 122 of the bobbin 142. It should be appreciated that the bobbin assembly 140 includes a primary electromagnetic coil (not shown) wound on the bobbin 142 to create a magnetic field when energized. It should also be appreciated that the connector 118 connects with the electromagnetic coil and to ground (not shown). It should further be appreciated that the connector 118 receives a continuous variable, digital control signal from a primary driver (not shown) such as the electronic controller (not shown).

Referring to FIG. 8, the solenoid 110 includes a sleeve 116 (FIGS. 9 and 10) assembled to the bobbin assembly 140. In one embodiment, the sleeve 116 is generally cylindrical in shape and includes a first portion 117*a* and a second portion 117*b* extending axially form the first portion 117*a* and having a diameter less than the first portion 117*a*. The sleeve 116 is generally circular in cross-sectional shape. It should be appreciated that the first portion 117*a* is disposed within the can 112 and the second portion 117*b* extends axially from the first portion 117*a*.

Referring to FIG. 10, the additional material 122 on the bobbin 142 is displaced during roll-forming to maintain a smooth path for the rollers and to secure the sleeve 116, pole piece 123, bobbin assembly 140, and connector 118 to the can 112. The additional material 122 is continuous with a flange portion 126 of the can 112 formed by the roll-forming method. As illustrated in FIG. 10, one axial end of the can 112 is roll-formed by the rollers to form the flange 126 of the can 112 extending radially and circumferentially. The flange 126 has a roll-formed surface 134 formed by the roll-forming method. It should be appreciated that the additional material 122 melds or integrates with the material of the bobbin 142 and/or can 112.

Accordingly, the present invention provides a method, according to the present invention, for roll-forming with gap fillers for the can 12, 112 of the solenoid 10, 110 used for a transmission. The method includes the steps of providing the can 12, 112 of the solenoid 10, 110. The can 12, 112 has a discontinuous surface 36, 136 with a gap 14, 114. The method also includes the steps of providing the connector 118, bobbin 142, pole-piece 123, and sleeve 116 and installing the bobbin 142, connector 18, 118, and sleeve 16, 116 in the gap 14, 114 from an axial end of the can 12, 112. The method includes the steps of providing additional material 22, 122 in the gap 14, 114. The additional material 22, 122 is either one of a plastic material and a metal material capable of absorbing a roll-forming load and deforming with a roll-formed surface 34, 134. The method further includes the steps of roll-forming the additional material 22, 122 in the gap 14, 114 simultaneously with roll-forming the can 12, 112 to maintain a smooth path for the rollers and securing the sleeve 16, 116, bobbin 142, and the connector 18, 118 to the can 12, 112 during roll-forming for the solenoid 10, 110.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the invention may be practiced other than as specifically described.

What is claimed is:

1. A method for roll-forming with gap fillers for a solenoid used for a transmission, said method comprising the steps of:

providing a can of a solenoid, the can having a discontinuous surface with a gap;

providing additional material in the gap; and roll-forming the additional material in the gap simultaneously with roll-forming the can to maintain a smooth path for rollers during roll-forming for the solenoid.

2. The method as set forth in claim 1 including the step of providing at least one of a connector, a bobbin, and a sleeve and installing the connector and sleeve in the can from an axial end of the can.

3. The method as set forth in claim 2 wherein the step of adding includes placing additional material in the gap.

4. The method as set forth in claim 3 wherein the step of displacing includes displacing the additional material to maintain a smooth path for the rollers and securing the at least one of the sleeve, the bobbin, and the connector to the can during roll-forming.

5. The method as set forth in claim 2 wherein the additional material is provided on the sleeve.

6. The method as set forth in claim 2 wherein the additional material is provided on the bobbin.

7. The method as set forth in claim 1 wherein the additional material is either one of a plastic material and a metal material capable of absorbing a roll-forming load and deforming with a roll-formed surface.

8. A method for roll-forming with gap fillers for a can of a solenoid used for a transmission, said method comprising the steps of:

providing a can of a solenoid, the can having a discontinuous surface with a gap;

providing at least one of a bobbin, a connector, and a sleeve;

installing the at least one of the bobbin, the connector, and the sleeve in the can from an axial end of the can;

providing additional material in the gap; and roll-forming the additional material in the gap while simultaneously roll-forming the can to maintain a smooth path for rollers during roll-forming for the solenoid.

9. The method as set forth in claim 8 wherein the step of displacing includes displacing the additional material to maintain a smooth path for the rollers and securing the at least one of the bobbin, the sleeve, and the connector to the can during roll-forming.

10. The method as set forth in claim 8 wherein the additional material is either one of a plastic material and a metal material capable of absorbing a roll-forming load and deforming with a roll-formed surface.

11. The method as set forth in claim 8 wherein the additional material is provided on the sleeve.

12. The method as set forth in claim 8 wherein the additional material is provided on the bobbin.

13. A method for roll-forming with gap fillers for a can of a solenoid used for a transmission, said method comprising the steps of:

providing a can of a solenoid, the can having a discontinuous surface with a gap;

providing a bobbin, a connector, and a sleeve;

installing the bobbin, the connector, and the sleeve in the can from an axial end of the can;

providing additional material to either one of the bobbin and the sleeve in the gap, wherein the additional material is either one of a plastic material and a metal material capable of absorbing a roll-forming load and deforming with a roll-formed surface; and roll-forming the additional material on the sleeve while simultaneously roll-forming the can to maintain a smooth path for the rollers and securing the bobbin, the sleeve, and the connector to the can during roll-forming for the solenoid.

* * * * *